United States Patent [19]

Murakami

[11] 4,140,311

[45] Feb. 20, 1979

[54] BABY WALKER

[75] Inventor: Mitsuo Murakami, Higashi-Osaka, Japan

[73] Assignee: Kabushiki Kaisha Famy, Osaka, Japan

[21] Appl. No.: 802,983

[22] Filed: Jun. 2, 1977

[30] Foreign Application Priority Data

Sep. 8, 1976 [JP] Japan ..... 51-121568[U]

[51] Int. Cl.[2] ..... A47D 13/04

[52] U.S. Cl. ..... 272/70.3; 108/115; 248/188.6; 280/87.05; 297/5

[58] Field of Search ..... 272/70.3; 248/188.6, 248/166, 439, 434, 435; 297/5, 136, 274, 275; 108/115, 127; 280/87.02 R, 87.02 W, 87.05; 403/83, 84, 94, 102

[56] References Cited

U.S. PATENT DOCUMENTS

| | | | |
|---|---|---|---|
| 3,504,927 | 4/1970 | Seki | 280/87.05 |
| 3,796,430 | 3/1974 | Sudo | 272/70.3 |
| 4,025,083 | 5/1977 | Saint | 280/87.05 |
| 4,065,086 | 12/1977 | Nakao | 248/188.6 |

*Primary Examiner*—Richard C. Pinkham
*Assistant Examiner*—Arnold W. Kramer
*Attorney, Agent, or Firm*—Koda and Androlia

[57] ABSTRACT

A baby walker comprises a travelable frame, a table positioned above the frame for supporting the trunk of an infant, and a plurality of support legs interconnecting and supporting the frame and the table. Each of the support legs is divided into an upper leg portion and a lower leg portion connected together by a joint so as to be foldable into the space between the table and the frame. The joint has a bearing portion and a pair of restraining walls formed on the opposite sides of the bearing portion and bent inward as opposed to each other. One of the leg portions of the support leg has a pair of support portions and pivot portions inwardly projecting from the support portions respectively, the support portions being movable toward and away from each other and biased at all times outward away from each other. The pivot portions are turnably supported by the bearing portion of the joint. With the support portions gripped by the restraining walls of the joint, the upper and lower leg portions are held in place against folding. When the support portions are pushed inward toward each other out of engagement with the restraining walls and pivotally turned over on the joint, the upper and lower legs portions are folded, thereby bringing the table and the frame over each other, whereby the walker is collapsed to a compact form.

3 Claims, 7 Drawing Figures

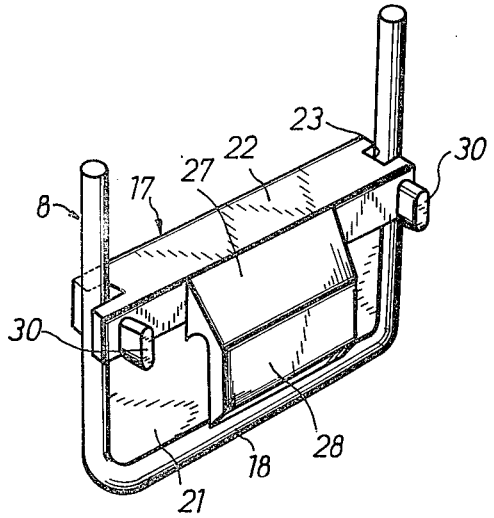
Fig. 3
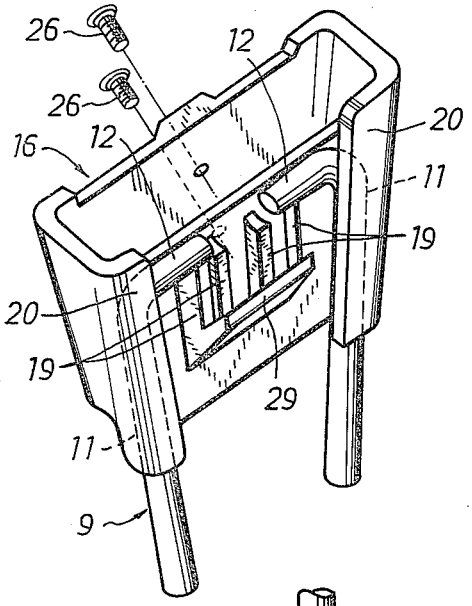
Fig. 4
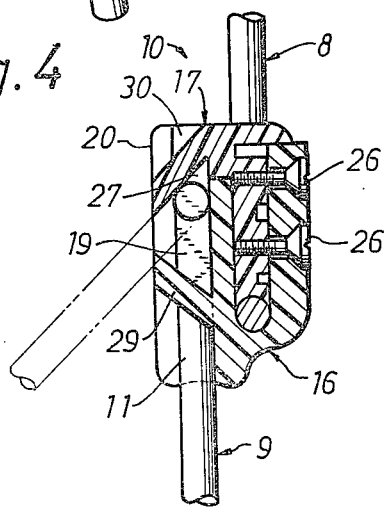

BABY WALKER

BACKGROUND OF THE INVENTION

This invention relates to a baby walker to be used by an infant in learning to walk, and more particularly to a foldable walker which is convenient to store and carry.

As is well known, the walker to be used by an infant who is learning to walk comprises a frame provided with casters, a table positioned above the frame for supporting the trunk of the infant and support legs interconnecting and supporting the frame and the table, such that when the infant strolls on the floor with his trunk supported by the table, the device advances on the casters, thus enabling the infant to learn to walk.

However, such a walker is bulky and incovenient to store and carry because the frame and the table are spaced apart from each other and connected together by the support legs. The walker may be collapsible to a compact form if the support legs are foldable, but the conventional folding means, when incorporated into the legs, fails to fulfil the following requirements.

The support legs must rigidly support the infant supporting table above the frame, free of any inadvertent folding even when the walker is moved about briskly.

The support legs must be readily foldable when the walker is not used and readily unfoldable for use so as to render the walker easily collapsible and restorable to shape by the user at home.

The support legs must be compact such that the briskly moving foot or leg of the infant will not be injured by contact therewith. Furthermore, the walker must not be one that will injure the body of another person by contact therewith during use.

SUMMARY OF THE INVENTION

An object of this invention is to provide a walker having support legs which are foldable to make the walker collapsible to a compact state and to thereby render the walker convenient to store and carry.

Another object of this invention is to provide a walker having support legs which rigidly support a table above a frame during use free of any inadvertent folding to ensure safety.

Another object of this invention is to provide a walker having support legs which are very easily and readily foldable and unfoldable even by the user at home.

Another object of this invention is to provide a walker including uspport legs each having a folding portion which will not injure the human body by contact therewith to ensure safety.

Another object of this invention is to provide a walker including support legs foldable by means of simple structure which can be manufactured with ease and by which the support legs can be easily assembled into the walker.

Other objects, features and benefits of this invention will become more apparent from the following description given with reference to the accompanying drawings.

BRIEF DESCRIPTION OF THE DRAWINGS

FIG. 3 is an exploded perspective view of the joint;

FIG. 4 is a view in section taken along the line IV—IV in FIG. 2;

DESCRIPTION OF THE PREFERRED EMBODIMENT

Figure 1:
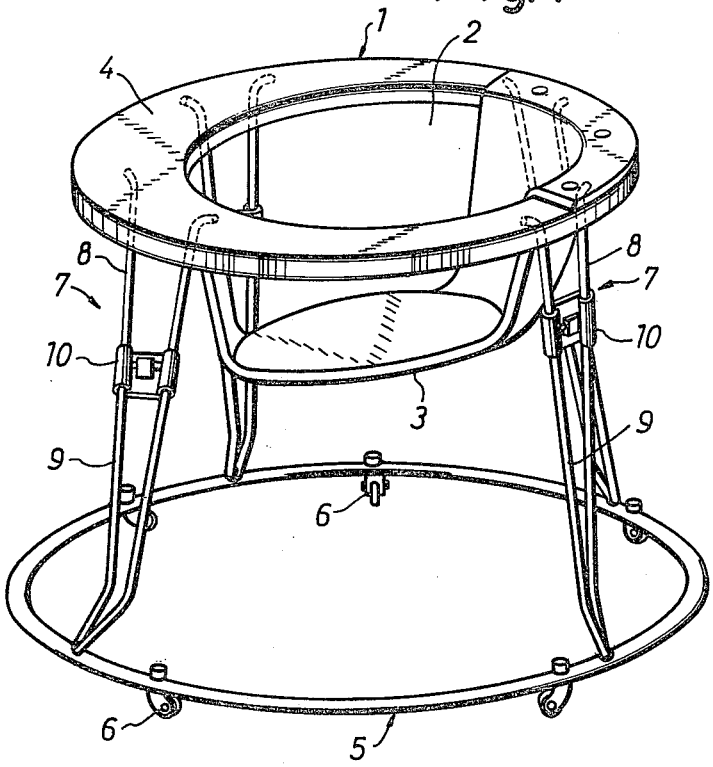
FIG. 1 is a perspective view showing a walker according to this invention.

FIG. 1 shows a preferred embodiment of the baby walker of this invention. An annular table 1 made of plastic material has a front side facing the direction in which the walker travels and is formed with an eccentric opening 2 positioned closer to the rear side of the table 1. A saddle 3 suspended from the inner peripheral edge of the table 1 is positioned below the opening 2. The front portion of the table 1 serves as a tray 4. An annular frame 5 made of metal pipe has a larger diameter than the table 1 and is provided with several casters 6 on the bottom of the frame 5. Support legs 7 supporting the table 1 above the frame 5 connect them together. Each of the support legs 7 comprises divided upper leg portion 8 and lower leg portion 9 which are interconnected by a joint 10 so as to be foldable into the space between the table 1 and the frame 5. The upper leg portion 8 is in the form of a substantially U-shaped rod, while the lower leg portion 9 is in the form of a substantially V-shaped rod having a pair of support portions 11. As seen in FIG. 3, the ends of the support portions 11 are bent inward to provide pivot portions 12.

Figure 2:
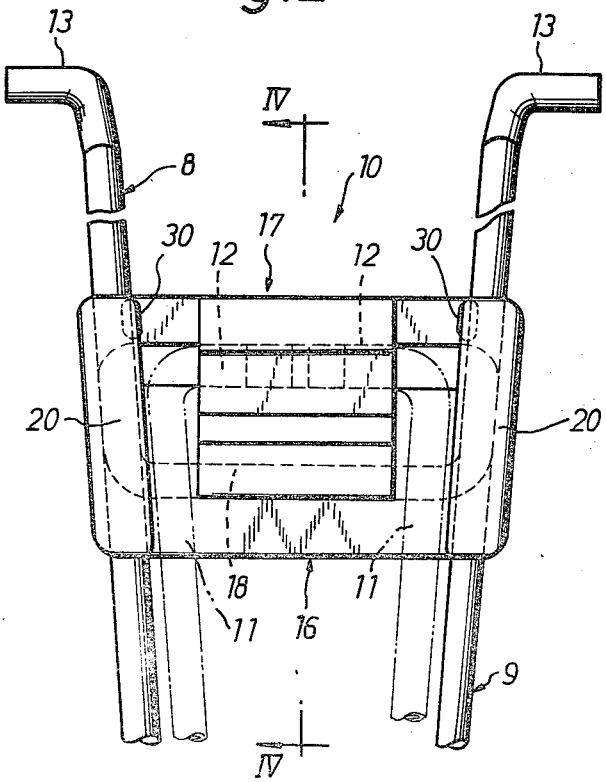
FIG. 2 is a front view showing a joint on a support leg.
Figure 5:
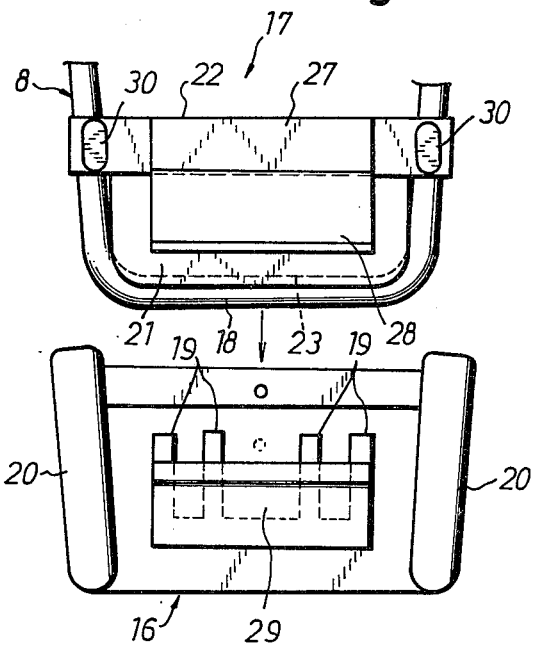
FIG. 5 is an exploded front view of the joint.
Figure 6:
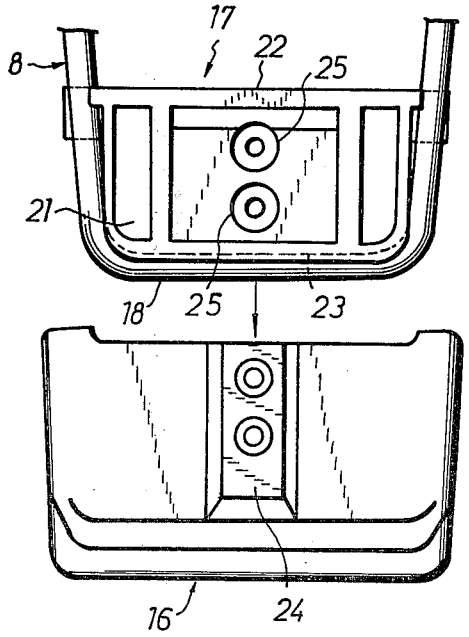
FIG. 6 is an exploded rear view of the joint.
Figure 7:
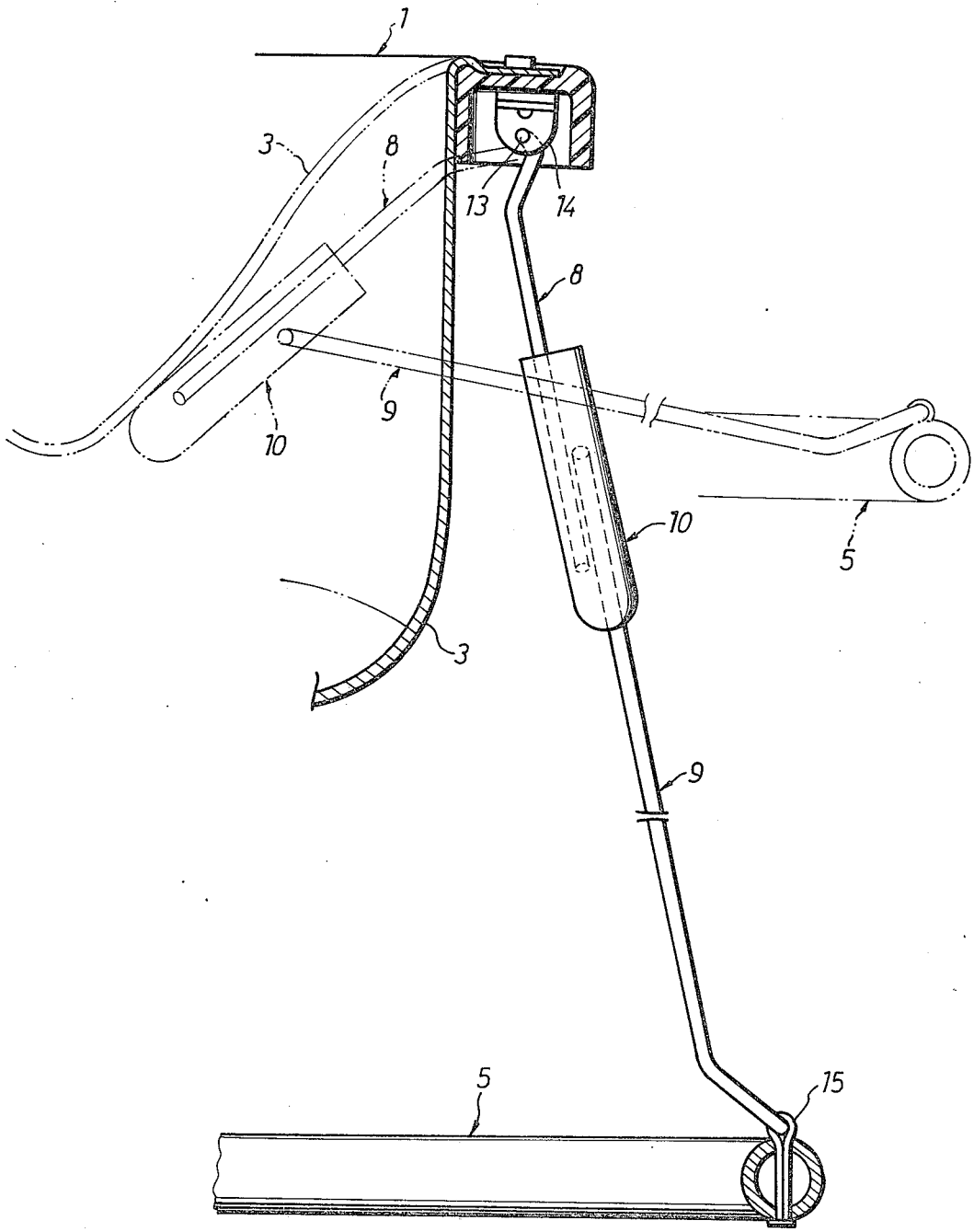
FIG. 7 is a fragmentary enlarged view showing how the support leg is folded.

With reference to FIGS. 2 and 7, the opposite ends of the upper leg portion 8 are bent inward, and the bent ends are turnably supported by lugs 14 secured to the bottom of the table 1. The sharp V-shaped end of the lower leg portion 9 is pivotably connected to an upper portion of the frame 5 by a loop 15. A plurality of the support legs 7, each comprising the upper and lower leg portions 8 and 9, are arranged at equal spacing circumferentially of the table 1 and the frame 5. The illustrated embodiment includes four support legs 7.

FIGS. 2 to 6 show a preferred embodiment of the joint 10. The joint 10 comprises a casing member 16 and an insert member 17 inserted into the casing member 16. Each of these members is integrally molded from plastic material. The casing member 16 is in the form of a flat box having an upper opening for accommodating the U-shaped bent portion 18 of the upper leg portion 8. The casing member 16 is formed at the center of its front wall with a bearing portion in the form of ribs 19 and has a pair of restraining walls 20 extending from its opposite side edges and bent inward as opposed to each other, with the bearing portion 19 positioned therebetween. The restraining walls 20 hold the support portions 11 of the lower leg portion 9 in gripping engagement therewith, and the pivot portions 12 of the lower leg portion 9 are supported by the ends of the ribs 19. The insert member 17 has an inserting portion 21 inserted into the casing member 16 and a cover portion 22 closing the opening of the casing member 16. A groove 23 extends from one side edge of the cover portion 22 along the peripheral edge of the inserting portion 21 to the other side edge thereof. When the inserting portion 21 is inserted into the casing member 16, with the U-shaped bent portion 18 of the upper leg portion 8 fitting in the groove 23, screws 26 are driven through a rear thick portion 24 on the casing member 16 into seats 25 on the insert member 17, whereby the insert member 17 is inseparably secured to the casing member 16. The bent portion 18 is in fitting engagement with the interior surface of the casing member 16. The cover portion 22 of the insert member 17 is provided with a holding portion 27 opposed to the bearing portion 19 of the casing member 16 and holding the pivot portions 12 of the lower leg portion 9 to the bearing portion 19. The holding portion 27 extends into an extension 28 covering the ribs 19 of the bearing portion and engaging a receiving portion 29 extending upward from the bearing portion. Stoppers 30 provided close to the opposite ends of the cover portion 22 are positioned in the bent portions of the restraining walls 20 and are located close the open end of the casing member 16. The inside surface of each stopper 30 is substantially in register with the inside edge of the corresponding restraining wall 20.

The support leg of the walker will be assembled in the following manner with the use of the joint 10. The pair of support portions 11 of the lower leg portion 9 are pushed toward each other, then fitted into the bent portions of the restraining walls 20 on the casing member 16 and thereby gripped by the walls 20, with the pivot portions 12 bearing against the ends of the ribs 19. On the other hand, the U-shaped bent portion 18 of the upper leg portion 8 is fitted into the groove 23 of the insert member 17. The upper leg portion 8 is then inserted into the casing member 16 together with the insert member 17, and the extension 28 engaged with the receiving portion 29. The insert member 17 is secured to the casing member 16 by the screws 26. Thus the parts can be assembled with ease.

The walker thus assembled is used for the learning of walking by an infant who rides on the saddle 3 with his trunk supported by the open portion of the table 1. When the infant walks on the floor within the frame 5, the walker advances on the casters 6 supporting the frame 5. Although each of the support legs 7 is divided into the upper and lower leg portions 8 and 9, the upper leg portion 8 has its U-shaped bent portion 18 entirely held by the joint 10, while the lower leg portion 9 has its support portions 11 gripped by the restraining walls 20 and its pivot portions 12 held between the bearing portion 19 and the holding portion 27. Thus the table 1 is rigidly supported above the frame 5. Since the joint 10 encloses the connection between the upper and lower leg portion 8 and 9 with its casing member 16 and insert member 17, the connection will not injure the human body when coming into contact therewith.

When the walker is not used, the support legs 7 are folded into the space between the frame 5 and the table 1, collapsing the walker to a compacted form. More specifically stated, although the support portions 11 are biased outward away from each other at all times by the rod material forming the lower leg 9, the support portions 11, when pushed toward each other by being gripped, will be disengaged from the restraining walls 20. If the lower leg portion 9 is then turned over on the joint 10 about the pivot portions 12, the upper and lower leg portions 8 and 9 will be folded into the space between the table 1 and the frame 5, thereby bringing the table 1 and the frame 5 over each other to collapse the walker to a compacted form. When the lower leg portion 9 has been turned over on the joint 10, the support portions 11 are retained in their inwardly pushed position by the stoppers 30 in contact therewith. To use the walker, the support legs 7 are unfolded merely by turning back each of the lower leg portions 9 about the pivot portions 12 into alignment with a phantom line extending from the upper leg portion 8 without any necessity of gripping the support portions 11 as above. When the lower leg portion 9 is returned to position on the front wall of the casing member 16, the support portions 11, which are self-biased, will be automatically brought into the bent portions of the restraining walls 20. In this way, the support legs 7 are foldable and unfoldable with extreme ease even by the user at home.

Needless to say, the present invention is not limited to the illustrated embodiment. For example, the illustrated support leg 7 comprising the upper and lower leg portions 8 and 9, can be inverted, in which case the upper leg portion has the support portions and pivot portions.

What is claimed is:

1. A baby walker including a travelable frame, a table positioned above the frame for supporting the trunk of an infant, and a plurality of support legs interconnecting and supporting the frame and the table, comprising:

each of said support legs being divided into an upper leg portion and a lower leg portion connected together by a joint so as to be foldable into the space between said table and said frame;

said joint including a casing member and an insert member inserted into said casing member, each of said members being integrally molded from plastic material, said casing member being provided on a wall surface thereof with a bearing portion and a pair of restraining walls formed on the opposite sides of said bearing portion and bent inward as opposed to each other, said bearing portion being in a form of ribs and having a receiving portion at lower ends thereof, said insert member having a holding portion opposed to the bearing portion on said casing member, said holding portion having an extension downwardly to be engaged to the receiving portion of said casing member;

said upper leg portion of said support leg being substantially U-shaped and having a U-shaped bent portion extending along and fitting to a peripheral edge of said insert member and inserted into said casing member together with said insert member; and said lower leg portion of said support leg having a pair of support portions and pivot portions inwardly projecting from said support portions respectively, said support portions being movable toward and away from each other and biased at all times outward away from each other, said pivot portions being turnably held on the bearing portion of said casing member by the holding portion of said insert member with said support portions gripped by the restraining walls of said joint, so that when said pair of support portions are pushed inward toward each other out of engagement with the restraining walls, said upper and lower leg portions are foldable toward each other pivotally about said pivot portions.

2. A baby walker as defined in claim 1 wherein said insert member has stoppers positioned in the bent portions of the restraining walls of said casing member respectively and each having an inside surface substantially in register with the inside edge of the corresponding restraining wall, so that when said support portions are pushed inward toward each other out of engagement with the restraining walls and pivotally turned over on said joint, said support portions are retained in their inwardly pushed position by the stoppers without being permitted to return outward.

3. A baby walker including a travelable frame, a table positioned above the frame for supporting the trunk of an infant and a plurality of support legs interconnecting and supporting the frame and the table, each of said support legs comprising an upper leg portion and a lower leg portion coupled together by a joint, said baby walker characterized in that:

said joint comprises:

a casing member comprising:

a body;

a longitudinally extended cavity provided in a top of said body;

a pair of opposing restraining walls extending from opposite edges of said body and bent inwardly such that a pair of channels are formed between the restraining walls and an outside surface of said body;

a receiving portion formed on said body adjacent said restraining walls, said receiving portion comprising a substantially straight member coupled at one end to said body and angled upwardly towards a top of said body;

a plurality of ribs formed on said body adjacent said restraining walls and subjacent said receiving portion, said ribs being integrally formed with said receiving portion; and a bearing provided on a top end of each of said ribs; and an insert portion for insertion into said casing member, said insert portion comprising:

a cover portion, said cover portion being generally bar-shaped and having a length corresponding substantially to the width of said body of said casing member;

a groove formed in each of the opposite ends of said cover portion;

a stopper formed on each end of said cover portion adjacent said grooves and extending in a direction substantially perpendicular to a side of said cover, said stoppers further being provided on said cover such that said stoppers extend into said channels formed by said restraining walls when said insert portion is inserted into said casing portion;

a holding portion provided on said cover, said holding portion comprising a substantially straight member coupled at one end to a side of said cover adjacent said stoppers and angled downwardly relative to a top of said cover;

an extension portion coupled to said holding portion and extending downwardly, said extension portion being provided such that when said insert portion is inserted into said casing portion, said extension portion is adjacent to said plurality of ribs and together with said holding portion, receiving portion and said ribs define a bearing cavity between said bearing on said ribs and an inside surface of said holding portion; and an inserting portion provided on a bottom of said cover for insertion into said longitudinal cavity, said inserting portion generally extending downwardly, said inserting portion further being such a length and width that once said insert portion is inserted into said casing portion, a generally U-shaped channel is formed between said inserting portion and said longitudinal cavity; and a means for fixedly coupling said case member to said insert member;

said upper leg portion is substantially U-shaped and a bottom and sides of said U being disposed in said U-shaped channel between said inserting portion and said longitudinal cavity; and said lower leg portion is substantially acute triangular shaped, said lower leg portion having an acute end rotatably coupled to said frame and a side of said triangular shape opposite said acute end comprising two inwardly projecting pivot portions continuously formed with the other sides of said triangular shape, said pivot portions fitting into said bearing cavity and engaging with said stoppers, said sides of said lower leg portion selectively fitting into said channels of said restraining walls;

whereby said upper leg portion is coupled to said lower leg portion by said joint such that said support legs are foldable into a space between said table and said frame.

* * * * *